US005571009A

United States Patent [19]

Stålhane et al.

[11] Patent Number: 5,571,009

[45] Date of Patent: Nov. 5, 1996

[54] GAS POWERED BURNER WITH PERFORATED CERAMIC ELEMENTS

[76] Inventors: Carl H. Stålhane; Maria B. E. Stålhane-Björnberg, both of Box 192, S-430, 93 Hälsö, Sweden

[21] Appl. No.: 170,363

[22] PCT Filed: Jun. 29, 1992

[86] PCT No.: PCT/SE92/00483

§ 371 Date: May 3, 1994

§ 102(e) Date: May 3, 1994

[87] PCT Pub. No.: WO93/01448

PCT Pub. Date: Jan. 21, 1993

[30] Foreign Application Priority Data

Jul. 8, 1991 [SE] Sweden ..... 9102134

[51] Int. Cl.[6] ..... F23D 14/12

[52] U.S. Cl. ..... 431/328; 431/329; 126/41 R

[58] Field of Search ..... 126/41 R; 431/328, 431/329

[56] References Cited

U.S. PATENT DOCUMENTS

| | | | |
|---|---|---|---|
| 2,987,118 | 6/1961 | Brown | 431/328 |
| 3,198,240 | 8/1965 | Keith et al. | 431/329 |
| 3,847,536 | 11/1974 | Lepage | 431/329 |
| 4,927,355 | 5/1990 | Haire et al. | 431/329 |

FOREIGN PATENT DOCUMENTS

| | | | |
|---|---|---|---|
| 164813 | 9/1984 | Japan | 431/329 |

*Primary Examiner*—Larry Jones

*Attorney, Agent, or Firm*—Birch, Stewart, Kolasch & Birch, LLP

[57] ABSTRACT

The invention discloses a gas powered burner with perforated ceramic elements which are adjustable in their planes and/or essentially perpendicular to their planes. The burner dan be adjusted so as to emit uniform infra-red radiation with good precision within the wavelength band, irrespective of how the burner is angled or located.

10 Claims, 5 Drawing Sheets

GAS POWERED BURNER WITH PERFORATED CERAMIC ELEMENTS

BACKGROUND OF THE INVENTION

1. Field of the Invention

The invention concerns a gas powered burner, emitting substantially infrared radiation, with perforated ceramic elements which are adjustable in and/or perpendicular to their planes.

Infrared is used nowadays in many different areas. Common weaknesses of existing gas powered constructions are:

1. Sensitivity to position. Existing constructions function adequately as long as they are horizontally mounted (radiating upwards or downwards). In vertical arrangements, due to the heat rising, the burner is warmer at the top than at the bottom, whereby the infra-red radiation becomes non-uniform. This results in it being impossible to set the desired wavelength on the infra-red emitter.
2. Difficulties to obtain an even high intensity at the same time as being able to adapt the wavelength in the infra-red spectrum to differing areas of application.
3. Inadequate efficiency. When the gas pressure and thereby the through-flow speed for the gas increases, the flames try to separate from the burner with the result that the heat emission to the infra-red radiating element reduces. The result is that convection heat increases and the infra-red radiation decreases.

SUMMARY OF THE INVENTION

With the invention, a gas powered burner has been achieved for emitting infra-red radiation. Due to the possibilities of adjustment of the infra-red radiating burner element, the burner is relatively insensitive to placement or position.

The burner element is intended to emit radiation within the infra-red spectrum, containing energy of sufficient intensity for industrial use such as for instance heating up solid or liquid material, drying of organic or inorganic material as well as hardening of, for example, paints or glue in so-called infra-red chambers or the like.

The invention can also advantageously be used for grills for grilling of food products since it can be placed vertically and thereby can give an odor free cooking of the raw products requiring most heat.

The construction of the burner according to the present invention is intended for all types of flammable gas. It is built up from two or more perforated plates or fire proof ceramic material. By displacing the two plates closest to the back part and which lie in contact with each other, symmetrical or asymmetrical hole patterns and hole geometries can be set up. This permits the gases which flow through the plates to be able to be directed in different directions. In addition to this, the construction allows the hole width to be able to be adjusted uniformly or asymmetrically in a continual throttling of the gas supply from one edge to the other. The construction of the burner permits the combustion chambers in and between the perforated ceramic plates, in principal, to be adjusted during operation. This means that the drawbacks, which results in uneven combustion and difficulties to keep all the emitted radiation within the desired wave-length in the infra-red spectrum, which occur when known gas powered infra-red radiators are placed vertically, can be removed via adjustment with this invention.

By placing one or more ceramic plates, perforated with holes, outside and at a suitable distance from the inner plate combination, a combustion chamber is achieved. This combustion chamber can be closed or provided with throttle valves for supply air. Should one use supply air to the chamber, automatic ignition and cut-out should be placed there. The supply air can occur passively or actively by the use of fans. It is mainly this outer plate or plate combination which constitutes the infra-red radiating element in the burner. By using two or more plates it is possible to achieve slanted or curved through-bore geometries. This means that the length of the through-bore which is created increases in relation to perpendicular holes whilst using the same thickness of burner element. This in turn implies that the heat absorbing surface on the infra-red radiating element increase with respect to if it was perforated by holes arranged at right angles. This relationship increases the efficiency.

The clay material included in the ceramic elements can be chosen such that the infra-red wavelength band is emitted at different temperatures. By a careful choice of ceramic material, the intensity within each wavelength can be controlled. The ceramic burner elements can be manufactured in plane or curved shapes and can be pressed or cast in different sizes.

A vertically placed gas powered infra-red radiator, as previously mentioned, always tends to be warmer at the top than at the bottom. To counteract this, the gas outlet can be directed downwardly and/or throttled successively from the lower outlet to the upper. In this manner a uniformity in the combustion and thereby the temperature can be maintained over the burner elements whole surface independently of the placing and the position of the burner. Additional, perforated plates can be added, the ceramic composition and the structure of which can be varied.

The burners according to the present invention are couplable together to large infra-red radiation units which, due to the burners' adjustability, can be constructed in many different ways. The burners can be put together in a laying or standing circle or respectively a half-circle shape and can even form complete radiation walls where each separate burner, independently of the placing in the group, can be optimized with regard to the wavelength and intensity emitted.

The invention can be illustrated by the burners being placed in a grill for grilling of food products, the resultant grill being particularly simple to maintain and which gives a very good grilling result for many different types of raw products. The characteristics of the burner according to the invention are defined in the appended claims.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention shall now be described in more detail with reference to the accompanying drawings, in which.

DETAILED DESCRIPTION OF THE PREFERRED EMBODIMENTS

Figure 1:
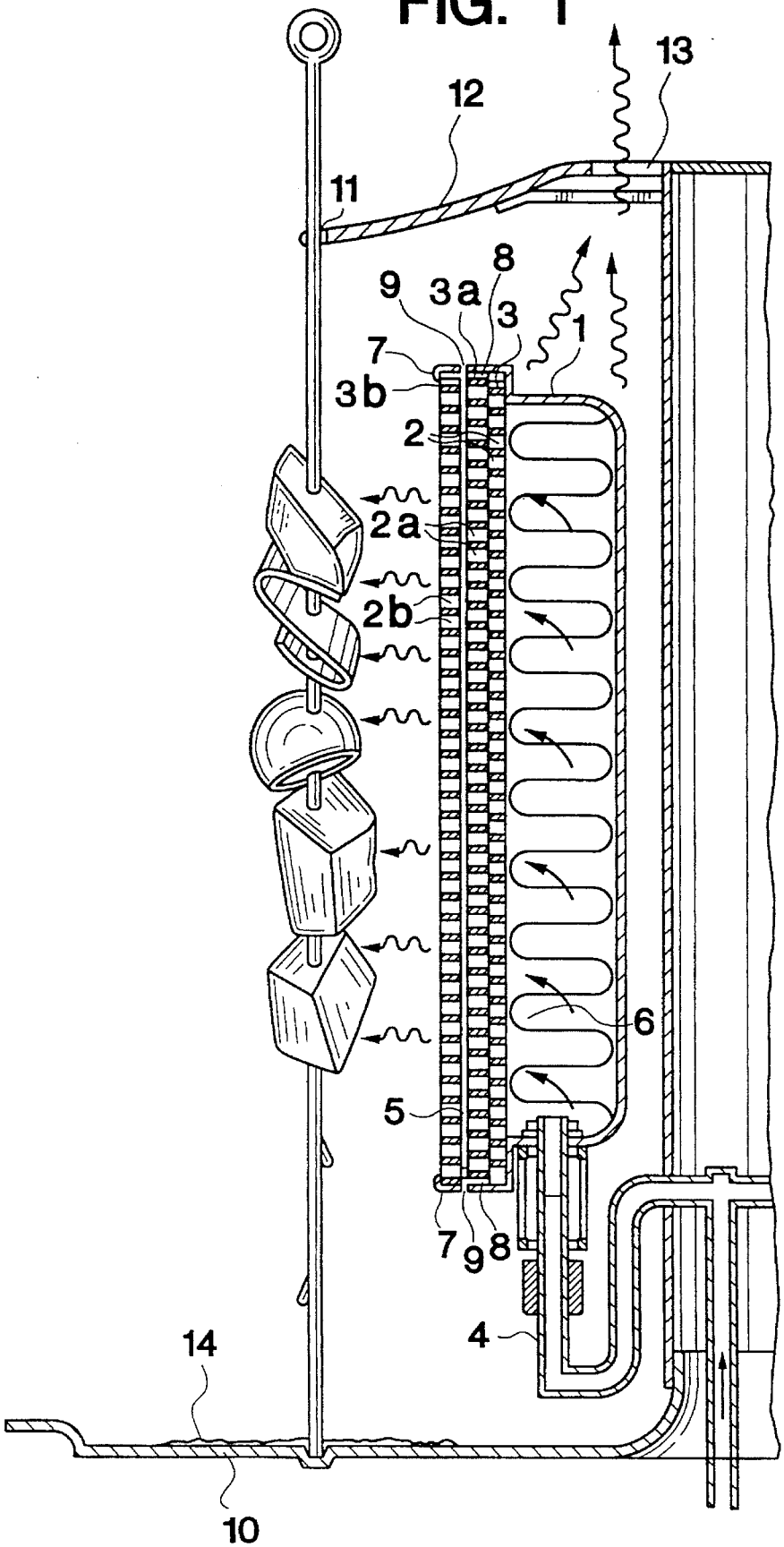
FIG. 1 shows a vertical section through a part of the burner according to the invention.
Figure 2:
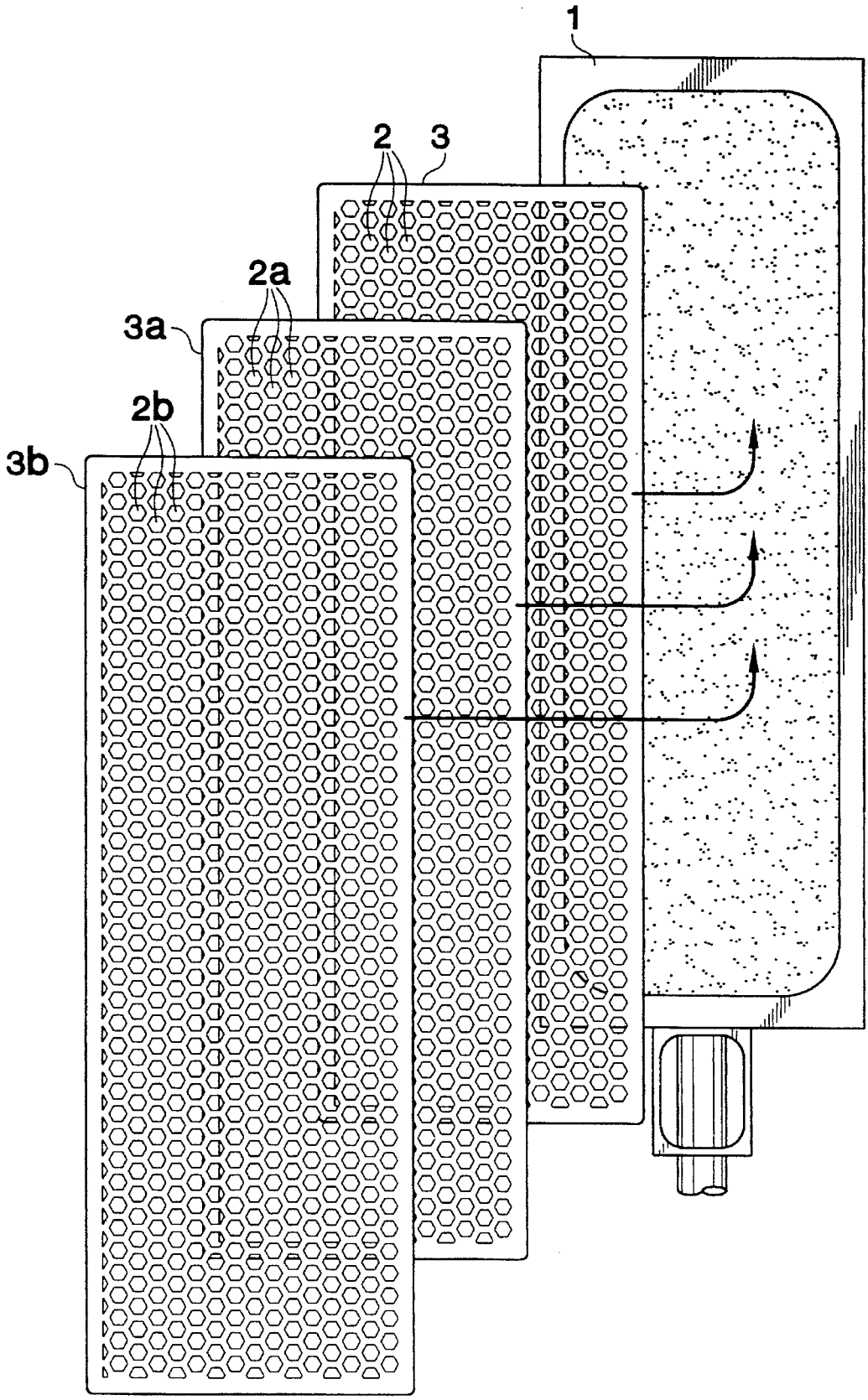
FIG. 2 shows the burner in FIG. 1 in an exploded view seen from the front.

The construction is, of course, not limited to the embodiments which are shown and described, but can be varied in many ways within the scope of the following claims. This concerns not only the number of burners 1 but also their relative location, along with the number of perforated ceramic plates 3, 3*a*, 3*b* included in each burner 1 and their appearance regarding the shape of the holes 2, 2*a*, 2*b*.

The main component of the arrangement is a gas powered burner 1, the basic form of which includes plates 3 of ceramic material perforated by holes 2. The shown embodiment comprises three plates 3, 3*a* and 3*b*, each provided with holes 2, 2*a*, 2*b*. The plates are placed in a frame 7 with a distance 8 between the outer periphery of the plates and the inner periphery of the frame. Frame 7 is further provided with openings 9 to allow the supply of oxygen to one or more combustion chambers 5.

A conduit 4 is attached to the burner 1 to provide a supply of gas. After being ignited, the gas warms up the perforated plates 3, 3*a*, 3*b* to red-hot temperature, whereby infra-red radiation is transmitted, said radiation being of a comparatively high frequency and thereby effective.

The holes 2, 2*a*, 2*b* can be round, three-, four-, five-, or six-sided or can have another shape for forming a pattern. Each of the plates 3, 3*a*, 3*b* is displaceable in its plane. In this way the ceramic lattice work of the three plates 3, 3*a*, 3*b* obtains holes with different opening widths in different regions. Thus the amount of gas flowing through the lattice work can be regulated to achieve the optimum effect.

As far as possible, the combustion should occur inside the lattice work. In order to prevent the combustion from reducing to an undesirably low level due to insufficient oxygen, the plates can conveniently be moved apart. FIG. 1 shows the plate 3*b* moved a little from the plate 3*a* for forming an air-gap 5 between these plates. In this way the oxygen supply to the combustion zone can be resulted and at the same time it can be ensured that the combustion occurs entirely inside the lattice work so that the energy content of the gas is absorbed to a maximum by the plates 3, 3*a*, 3*b*. The plates which lie in contact with the combustion area will hereby start to become red-hot and the outermost plate 3*b* emits energy in the form of infra-red radiation. The wavelength and the intensity are dependent on the energy supplied and the choice of materials for the burner elements. The wasted energy which flows out into the air is hereby negligible and the burner 1 thus functions very economically.

In order to avoid that the combustion zone, due to unfavorable adjustment of the plates 3, 3*a*, 3*b*, moving into the space behind the plates, this space is suitably filled up with any mineral wool, filter material 6 or the like. This material firstly presents an explosive type combustion of the gas, but at the same time provides a uniform distribution of the gas over the rear side of the lattice work.

Due to the fact that the plates are relatively adjustable, the burner 1 can be attached upright and meat juices from food products will therefore never contact the burners' surface, but instead they will travel down towards to the bottom plate. In this way no smell occurs.

Figure 3:
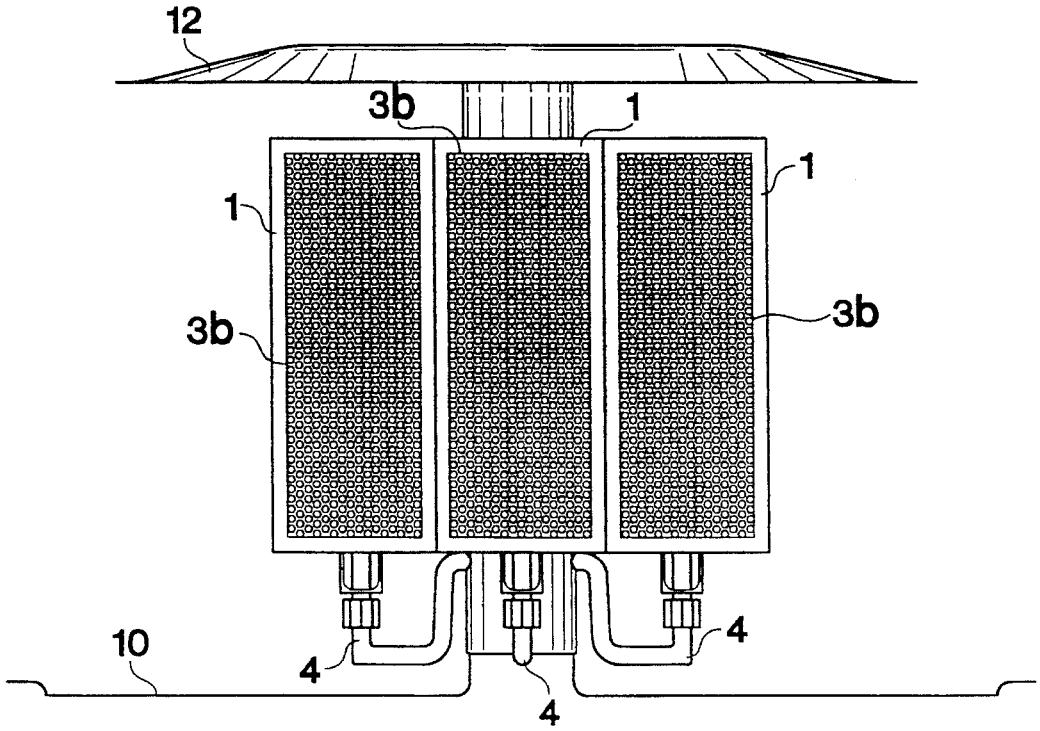
FIG. 3 shows the burner according to the invention from the side, coupled together according to one embodiment.
Figure 4:
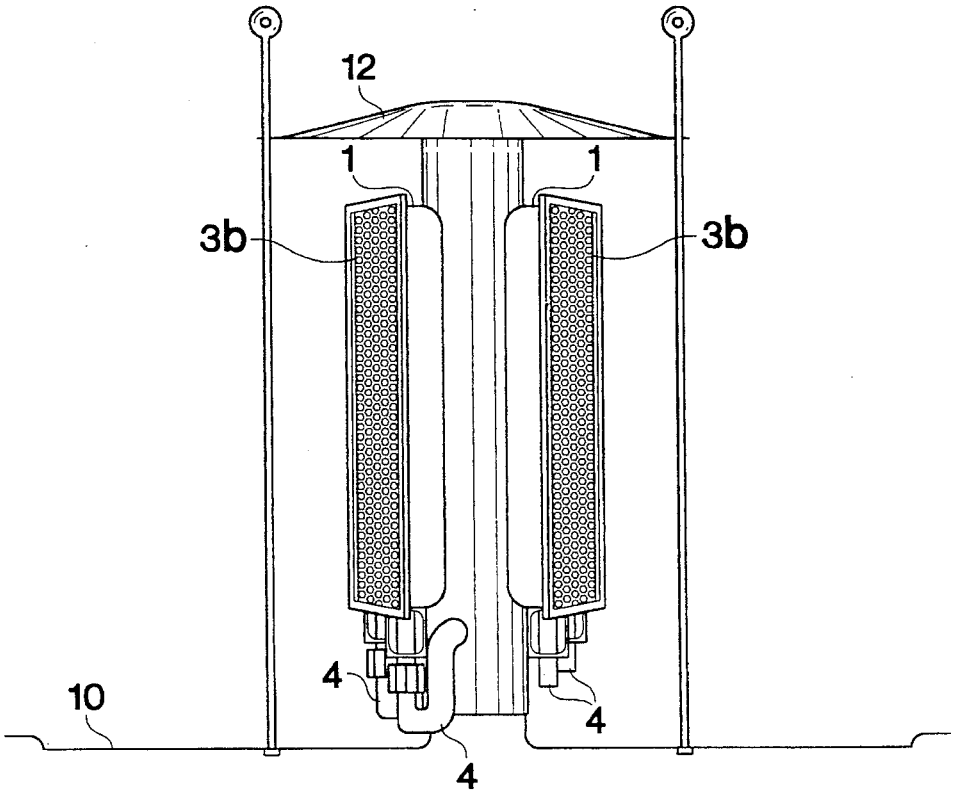
FIG. 4 shows another embodiment of the present invention.
Figure 5:
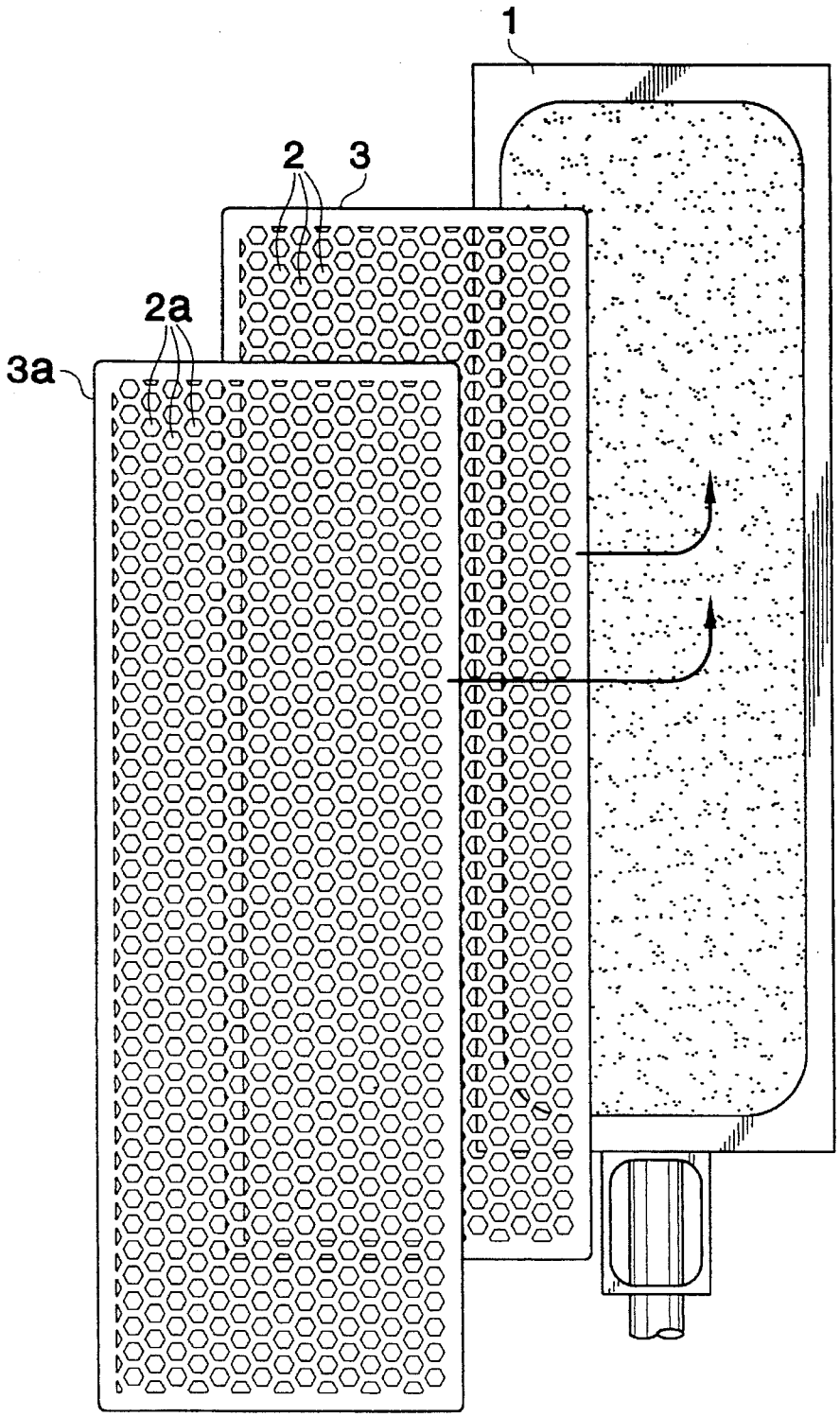
FIG. 5 shows the hole width decreasing with height by displacement of two perforated plates.
Figure 6:
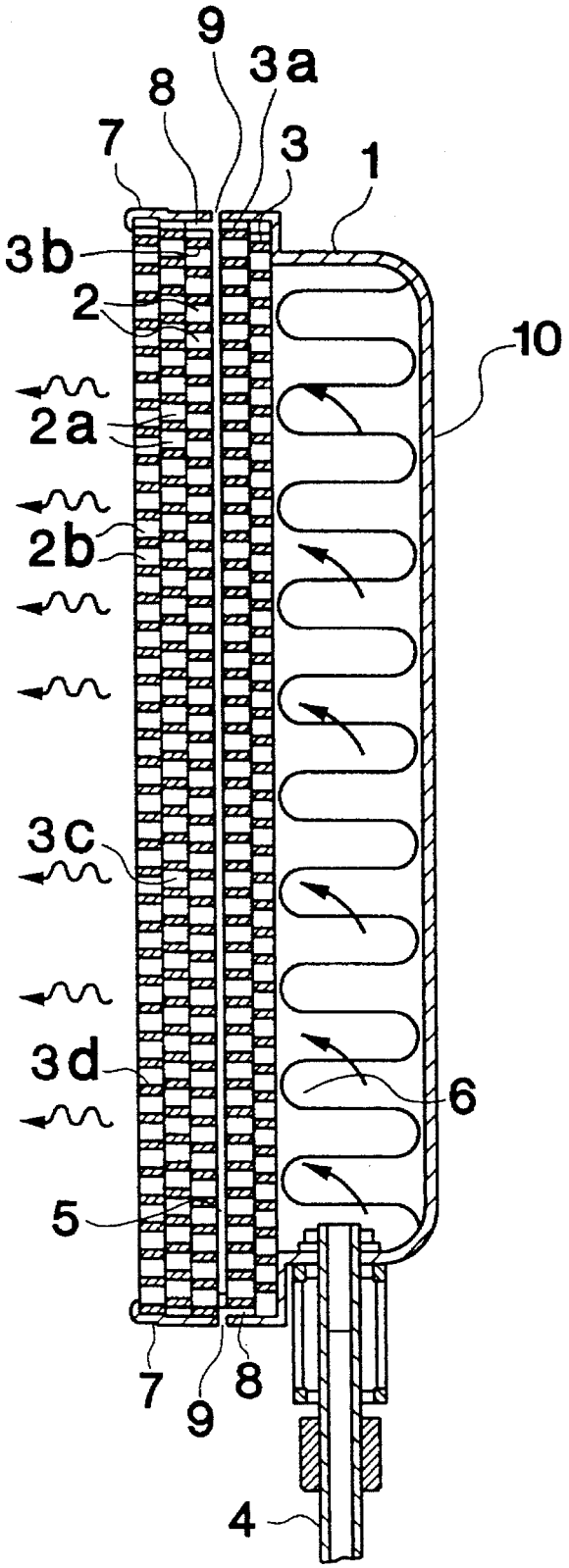
FIG. 6 shows a variation of the burner with five perforated plates.

The ignition of the gas can occur in a conventional manner using matches or fire lighters but it can also occur using a more sophisticated technique, such as for example a piezo-electric manner. An automatic ignition system of this type can conveniently be placed in the intermediate space between the flow-limiting plate combination and the heat radiating plate/plates combination. A combustion monitoring cut-out can also be placed in this intermediate space. FIG. 3 shows a combination of three burners placed close to each other and with a gas conduit 4 connected to each one of the burners.

We claim:

1. A gas powered burner for emitting infrared radiation, comprising:

a gas supply means for supplying gas to said gas powered burner;

oxygen supply means for supplying oxygen to said gas powered burner;

a housing connected to said gas supply means and having a back part;

at least tow ceramic plates adjacent to said housing, each ceramic plate having a plurality of perforations therein, said at least two ceramic plates lying in parallel with each other and being mutually adjustable relative to each other;

means for supplying said at least two ceramic plates and for adjusting a position of one of said at least two ceramic plates relative to one another and thereby adjusting a combustion chamber in and between said at least two ceramic plates; wherein said at least two ceramic plates constitute an infrared radiating element with radiation which is variable due to mutual adjustment of said at least two ceramic plates.

2. The gas powered burner according to claim 1, wherein said at least two ceramic plates are separable from each other for formation of at least one air space there between so as to control supply of oxygen to the burner.

3. The gas powered burner according to claim 1, wherein the at least two ceramic plates include at least three ceramic plates, said at least three ceramic plates being placed group wise with at least open substantially flow-controlling plate combination placed closest to said back part of said burner and additionally an outer, substantially radiation-emitting plate placed at a distance from the flow-controlling plate combination in order to form an air gap.

4. The gas powered burner according to claim 3, wherein automatic ignition and ignition cut-out are located in said air gap.

5. The gas powered burner according to claim 1, wherein upon relative displacement of the ceramic plates, through-holes in the ceramic plates are formed having varying geometry in their longitudinal section, whereby the available energy absorbing surface area for a ceramic plate is varied.

6. The gas powered burner according to claim 1, wherein the ceramic plates are placed in a frame, which is provided with openings to allow a supply of oxygen to at least one combustion chamber and, at the same time, allow the possibility of adjusting air introduction so as to ensure that combustion of gas occurs fully inside the burner so that the maximum energy content of the gas is absorbed by the ceramic plates.

7. The gas powered burner according to claim 6, wherein the frame for containing the ceramic plates, is larger than an outer perimeter of the back part, whereby the heat emission from the plates (3) to the metal frame is limited and an adjustment operation for the ceramic plates is easier to carry out.

8. The gas powered burner according to claim 7, wherein a space between an outer periphery of the ceramic plates and an inner periphery of the frame is filled with a resilient, insulating fireproof material.

9. The gas powered burner according to claim 1, wherein said back part is filled with filter material.

10. The gas powered burner according to claim 1, wherein automatic ignition and ignition cut-out are located in front of the ceramic plates.

* * * * *